US008292486B2

(12) United States Patent
Wang et al.

(10) Patent No.: US 8,292,486 B2
(45) Date of Patent: Oct. 23, 2012

(54) ILLUMINATION APPARATUS

(75) Inventors: Wei-Chih Wang, Hsin-Chu (TW); Wei-Chun Yang, Hsin-Chu (TW); Chi-Ming Tseng, Hsin-Chu (TW)

(73) Assignee: Young Lighting Technology Inc., Hsin-Chu (TW)

( * ) Notice: Subject to any disclaimer, the term of this patent is extended or adjusted under 35 U.S.C. 154(b) by 408 days.

(21) Appl. No.: 12/662,702

(22) Filed: Apr. 29, 2010

(65) Prior Publication Data

US 2010/0290251 A1 Nov. 18, 2010

(30) Foreign Application Priority Data

May 14, 2009 (TW) ..... 98115958 A

(51) Int. Cl.
*F21V 7/04* (2006.01)

(52) U.S. Cl. ..... 362/612; 362/613; 362/97.3

(58) Field of Classification Search ..... 362/612, 362/613, 615, 600, 608, 230, 231, 97.3, 249.02, 362/555, 800; 349/65
See application file for complete search history.

(56) References Cited

U.S. PATENT DOCUMENTS

| | | | | |
|---|---|---|---|---|
| 6,988,813 | B2 * | 1/2006 | Hoelen et al. | 362/601 |
| 7,448,785 | B2 * | 11/2008 | Suzuki | 362/612 |
| 7,780,330 | B2 * | 8/2010 | Aylward et al. | 362/613 |
| 7,891,854 | B2 * | 2/2011 | Hamada | 362/612 |
| 8,104,945 | B2 * | 1/2012 | Kim et al. | 362/631 |
| 2002/0047624 | A1 | 4/2002 | Stam et al. | |
| 2003/0043567 | A1 * | 3/2003 | Hoelen et al. | 362/31 |
| 2006/0221636 | A1 * | 10/2006 | Ohashi et al. | 362/612 |
| 2006/0289880 | A1 | 12/2006 | Kurihara | |
| 2007/0153548 | A1 * | 7/2007 | Hamada et al. | 362/615 |
| 2009/0021931 | A1 | 1/2009 | Mayer et al. | |
| 2009/0067178 | A1 | 3/2009 | Huang et al. | |
| 2009/0168455 | A1 * | 7/2009 | Kim et al. | 362/613 |
| 2009/0279284 | A1 * | 11/2009 | Takeuchi et al. | 362/97.3 |

FOREIGN PATENT DOCUMENTS

| | | | |
|---|---|---|---|
| DE | 102007012381 | A1 | 9/2008 |
| EP | 1643227 | A2 | 4/2006 |
| JP | 2005501390 | A | 1/2005 |
| JP | 200787659 | A | 4/2007 |

(Continued)

OTHER PUBLICATIONS

Notification mailed from JPO on Apr. 3, 2012 and English translation thereof.

(Continued)

*Primary Examiner* — Bao Q Truong
(74) *Attorney, Agent, or Firm* — Bacon & Thomas, PLLC

(57) ABSTRACT

An illumination apparatus includes a light guide plate, a first light source module, and a second light source module. The light guide plate has a first incident surface and a second incident surface opposite to the first incident surface. The first and the second light source modules provide light beams into the first and the second incident surfaces, respectively. The first light source module includes at least one first white light emitting diode (LED) and at least one second white LED neighboring with each other. The first and the second white LEDs have different color temperatures. The second light source module includes at least one third white LED and at least one forth white LED neighboring with each other. The third and the forth white LEDs have different color temperatures. The third and the forth white LEDs are located corresponding to the second and the first white LEDs, respectively.

13 Claims, 7 Drawing Sheets

FOREIGN PATENT DOCUMENTS

| | | | |
|---|---|---|---|
| JP | 2008152983 | A | 7/2008 |
| JP | 2008262823 | A | 10/2008 |
| TW | 347959 | | 12/1998 |
| TW | 509885 | | 11/2002 |
| TW | 522578 | | 3/2003 |
| TW | 532699 | | 5/2003 |
| TW | 594278 | | 6/2004 |
| TW | M243655 | | 9/2004 |
| TW | I226791 | | 1/2005 |
| TW | I228838 | | 3/2005 |
| TW | 200624706 | A | 7/2006 |
| TW | M298078 | | 9/2006 |
| TW | I279506 | | 4/2007 |
| TW | M314819 | | 7/2007 |
| TW | 200746469 | | 12/2007 |
| TW | M332777 | | 5/2008 |
| TW | 1297757 | | 6/2008 |
| TW | M339631 | | 9/2008 |
| WO | 02/47438 | A2 | 6/2002 |
| WO | 2007/125623 | A1 | 11/2007 |

OTHER PUBLICATIONS

Search notification report with the English version mailed from TIPO on Nov. 1, 2011.

European search report of application No. 10004714.1, dated Sep. 3, 2010.

* cited by examiner

ILLUMINATION APPARATUS

BACKGROUND OF THE INVENTION (1) Field of the Invention

The present invention relates to an illumination apparatus, particularly to an indoor illumination apparatus using white light emitting diodes as light source.

(2) Description of the Prior Art

Indoor illumination technology is widely used in office, living room, study room or bedroom for ceiling lamp or wall lamp. The indoor illumination apparatus needs non-directional and uniform light beam with a large angle to provide different brightness and color temperatures according to time and space. For example, when working in office, we need cold white light to increase attention; when dining in a rest place, we need soft warm white light to relax.

There are three types of light sources in the traditional indoor illumination apparatus: fluorescent lamp, halogen bulb, and energy-saving bulb. The fluorescent lamp emits uniform light and is usually used in main indoor space. The color temperature of the fluorescent lamp is about 6500K~3000K. The halogen bulb has a low luminance efficiency, for the halogen bulb is transparent and small, so the halogen bulb is often used in decorative art lamps. The above two bulbs both suffer from large heat, high power consumption, low luminance efficiency, and short life. The energy-saving bulb has screw or thread patterns with high luminance efficiency, but the light beam is concentrated around the bulb. The energy-saving bulb easily makes people feel dazzled and uncomfortable.

A light emitting diode (LED) is an environment-friendly light source. Compared with the traditional light source, LED is superior in life and power consumption. Furthermore, LED may be designed unlimitedly due to the small size of LED. Different color LEDs are provided for choosing, so we may switch color light to create an atmosphere and effect according to the activity or mood.

Currently, there are two kinds of LED lamps, as shown in FIG. 1 and FIG. 2.

In FIG. 1, a LED array module 100 has a plurality of white LEDs 120, adapted to the ceiling lamp or the cabinet illumination. For example, Taiwan patent No. M314819 discloses that white LED arrays with two different color temperatures are arranged on a substrate and the light beam from the LEDs is emitted out directly through the surface of the lamp. However, in such a way, the light beam from the point light sources forms light point easily but is hard to provide uniform plane light.

As FIG. 2 shows, a LED array module 200 has a plurality of red LEDs R, green LEDs G and blue LEDs B for being switched color lights optionally, suitable for a mood lamp. For example, Taiwan patent No. 509885 discloses that the light intensities of red LEDs, green LEDs, and blue LEDs are changed to amend color difference of the mixed light by adjusting width of the pulse wave. Taiwan patent No. 532699 discloses that the brightness and the color of the LEDs with different colors are adjusted corresponding to different voltages, so that the lamps may be more colorful and diversified. In addition, Taiwan patent No. 347959, 522578, I228838, I279506, I226791, and U.S. Pat. No. 6,441,558 also disclose that the white light source may be formed by mixing the lights of red LEDs, green LEDs, and blue LEDs.

Light beams of red LEDs R, green LEDs G, and blue LEDs B arranged in array may be emitted after being mixed effectively. Thus the enough distance for mixing light is needed. If the distance for mixing light is not enough, as shown in FIG. 3, a color spot 300 formed by the three interlaced colors appears on the margin of a bright region on the projection surface.

Though the illumination apparatus having red LED, green LED, and blue LED arrays may be adjusted color light from warm white to cold white, this technology currently is applied in small LED lamp to provide color change with lower brightness and also suffers from lower efficiency of mixing light and poor power saving property.

In addition, the above LED array modules 100 and 200 may also be used together in a same lamp. For example, the light emitting modules disclosed in Taiwan patent No. M332777 and No. I297757 include a first light emitting group and a second light emitting group. The first light emitting group has at least one white LED excited by fluorescent powder. The second light emitting group has LEDs emitting other colors. The color shift caused by the first light emitting group is amended by adjusting light intensity of the second light emitting group.

Most illumination technologies disclosed in the above reference patents such as Taiwan patent No. M332777, M314819, M298078, I226791 adopt a downward light source, that is, the light beam from the LED comes out directly through the lamp cover. However, the light beam from the point light source forms light point easily, and a uniform plane light is hard to be provided. Thus if the light beam enters human's eyes, glare is generated easily to make image vague and eyes tired, and the reading efficiency may be decreased.

Moreover, Taiwan publication No. 200746469 discloses a plurality of LED arrays arranged on a substrate. A LED array is regarded as main color, not limited to white, while other color LED arrays are regarded as complementary colors. The main color and the complementary colors are mixed to form white light. The average luminescent spectrum may be adjusted by the internal circuit, so as to form a color adjustable illumination apparatus. Noticeably, each LED in the case is fixed on the printed circuit board (PCB) in the form of chip rather than package. For errors of wavelength, brightness, and color come out during chip growth stage, the electrical and optical properties may change in the packaging stage. Thus, if LED in the illumination apparatus is fixed to the PCB in the form of chip, there may be still many errors in the follow-up process, and the color appearance of the LED may be affected.

SUMMARY OF THE INVENTION

Accordingly, the invention is to provide a thin indoor illumination apparatus having function of adjusting color temperature and brightness, and capable of providing uniform plane light for reducing glare.

To achieve one of, a part of or all of the above-mentioned advantages, an embodiment of the present invention provides an illumination apparatus including a light guide plate, a first light source module, and a second light source module. The light guide plate has a first incident surface and a second incident surface opposite to the first incident surface. The first light source module provides a light beam into the first incident surface of the light guide plate. The second light source module provides a light beam into the second incident surfaces of the light guide plate. The first light source module has at least one first white light emitting diode and at least one second white light emitting diode, wherein the first white light emitting diode has a first color temperature, the second white light emitting diode has a second color temperature different from the first color temperature. The second light source module has at least one third white light emitting diode and at least one forth white light emitting diode, the third white light emitting diode has a third color temperature, and the forth white light emitting diode has a forth color temperature different from the third color temperature. The position of the third white light emitting diode is corresponding to the position of the second white light emitting diode, and the position of the forth white light emitting diode is corresponding to the position of the first white light emitting diode.

In an example, the third white light emitting diode is located opposite to the second white light emitting diode, and the forth white light emitting diode is located opposite to the first white light emitting diode. The first color temperature is the same as the third color temperature, and the second color temperature is the same as the forth color temperature.

The light guide plate is a flat plate with dot pattern. The thickness of the light guide plate is smaller than 6 millimeter. The first color temperature or the second color temperature is in one of the ranges from 2200K to 3000K, 3000K to 4500K, 4500K to 6500K, and 6500K to 10000K.

The first light source module includes a first printed circuit board. Each of the first white light emitting diode and the second white light emitting diode includes a package structure, and the package structures of the first white light emitting diode and the second white light emitting diode are fixed on the first printed circuit board by surface mount technology. The second light source module further includes a second printed circuit board. Each of the third white light emitting diode and the forth white light emitting diode includes a package structure, and the package structures of the third white light emitting diode and the forth white light emitting diode are fixed on the second printed circuit board by surface mount technology.

The number of the first white light emitting diode and the number of the second white light emitting diode of the first light source module are different or the same.

The number of the third white light emitting diode and the number of the forth white light emitting diode of the second light source module are different or the same.

The embodiment or the embodiments of the invention may have at least one of the following advantages. The above embodiment uses two kinds of white light emitting diodes with different color temperatures as light source, cooperating with the light guide plate to generate uniform plane light, so as to overcome the glare caused by the conventional lamp. In different times and situations, the color temperature and brightness may be adjusted for rising the working performance, reducing error rate, and enhancing safety. The white light emitting diode is fixed on the printed circuit board with package form to make the color appearance stable. By the way, because the space for color light mixing of the light emitting diodes is located at two sides of the light guide plate, increasing the thickness of the illumination apparatus to provide the space for color light mixing of the light emitting diodes may be unnecessary, and a thin illumination apparatus may be carried out.

Other objectives, features and advantages of the present invention will be further understood from the further technological features disclosed by the embodiments of the present invention wherein there are shown and described preferred embodiments of this invention, simply by way of illustration of modes best suited to carry out the invention.

DESCRIPTION OF THE PREFERRED EMBODIMENTS

In the following detailed description of the preferred embodiments, reference is made to the accompanying drawings which form a part hereof, and in which is shown by way of illustration specific embodiments in which the invention may be practiced. In this regard, directional terminology, such as "top," "bottom," "front," "back," etc., is used with reference to the orientation of the Figure(s) being described. The components of the present invention can be positioned in a number of different orientations. As such, the directional terminology is used for purposes of illustration and is in no way limiting. On the other hand, the drawings are only schematic and the sizes of components may be exaggerated for clarity. It is to be understood that other embodiments may be utilized and structural changes may be made without departing from the scope of the present invention. Also, it is to be understood that the phraseology and terminology used herein are for the purpose of description and should not be regarded as limiting. The use of "including," "comprising," or "having" and variations thereof herein is meant to encompass the items listed thereafter and equivalents thereof as well as additional items. Unless limited otherwise, the terms "connected," "coupled," and "mounted" and variations thereof herein are used broadly and encompass direct and indirect connections, couplings, and mountings. Similarly, the terms "facing," "faces" and variations thereof herein are used broadly and encompass direct and indirect facing, and "adjacent to" and variations thereof herein are used broadly and encompass directly and indirectly "adjacent to". Therefore, the description of "A" component facing "B" component herein may contain the situations that "A" component facing "B" component directly or one or more additional components is between "A" component and "B" component. Also, the description of "A" component "adjacent to" "B" component herein may contain the situations that "A" component is directly "adjacent to" "B" component or one or more additional components is between "A" component and "B" component. Accordingly, the drawings and descriptions will be regarded as illustrative in nature and not as restrictive.

Figure 1:
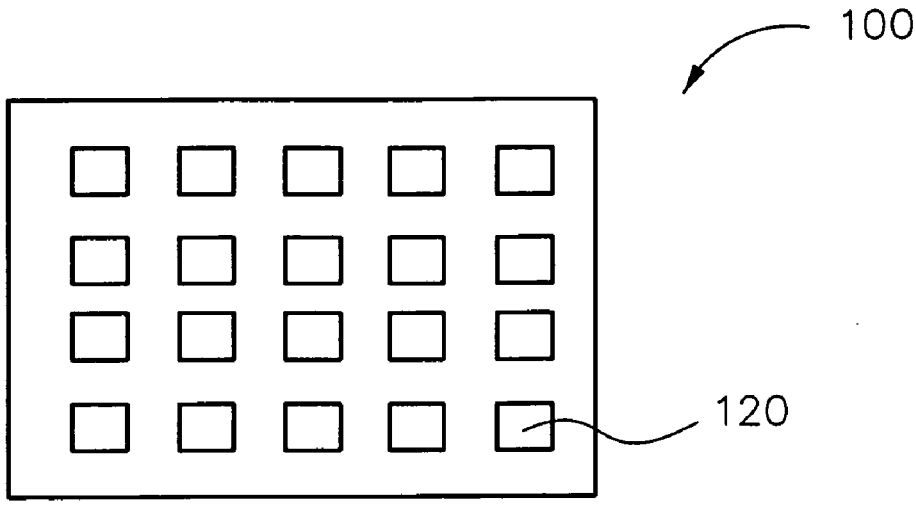
F I G . 1 ( Prior Art )
FIG. 1 is a schematic view of a conventional LED illumination apparatus.
Figure 2:
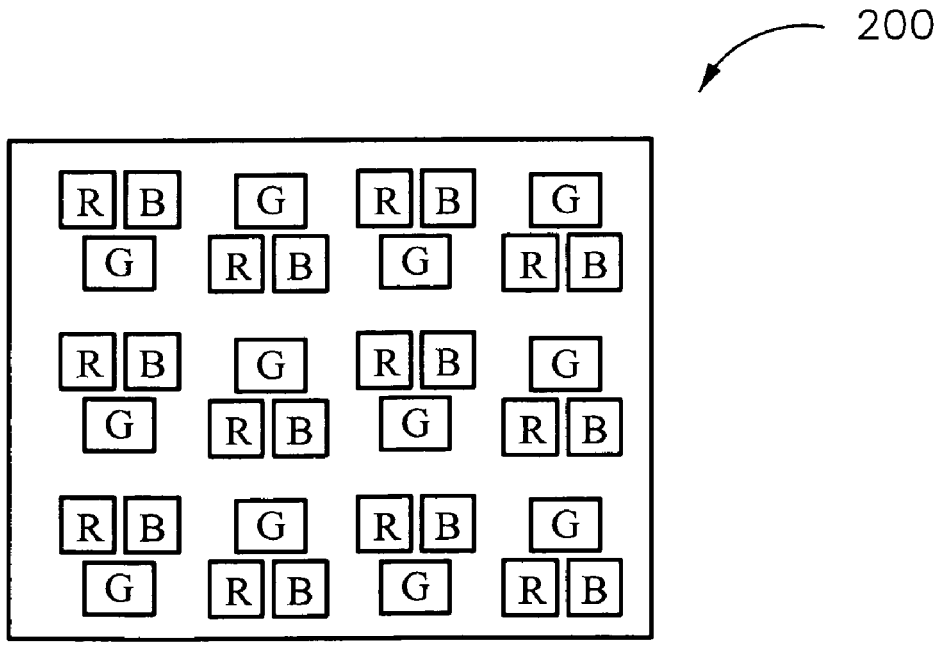
F I G . 2 ( Prior Art )
FIG. 2 is a schematic view of a conventional LED illumination apparatus.
Figure 3:
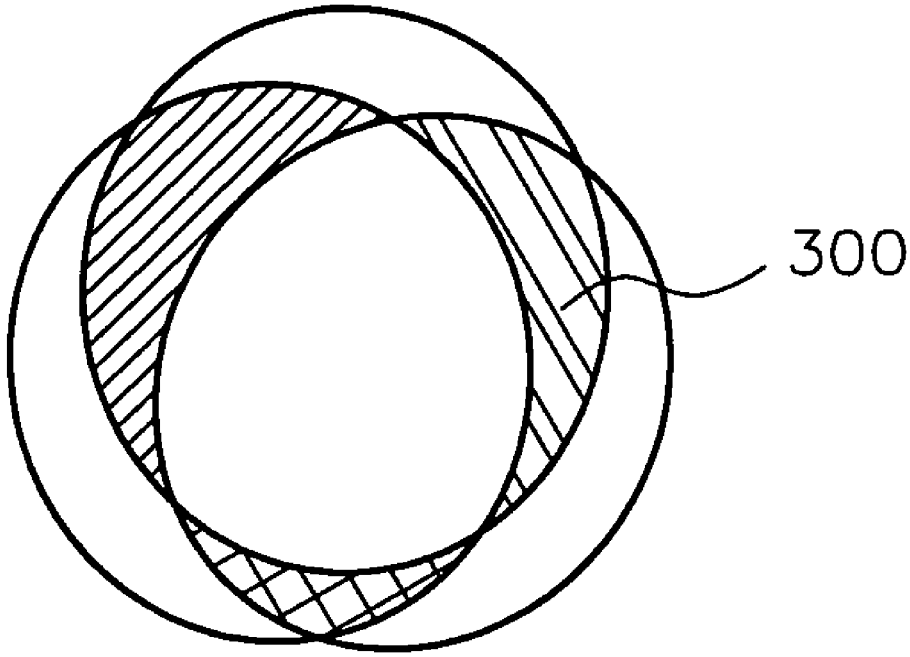
F I G . 3 ( Prior Art )
FIG. 3 is a schematic view of color spot generated by a conventional LED illumination apparatus.
Figure 4:
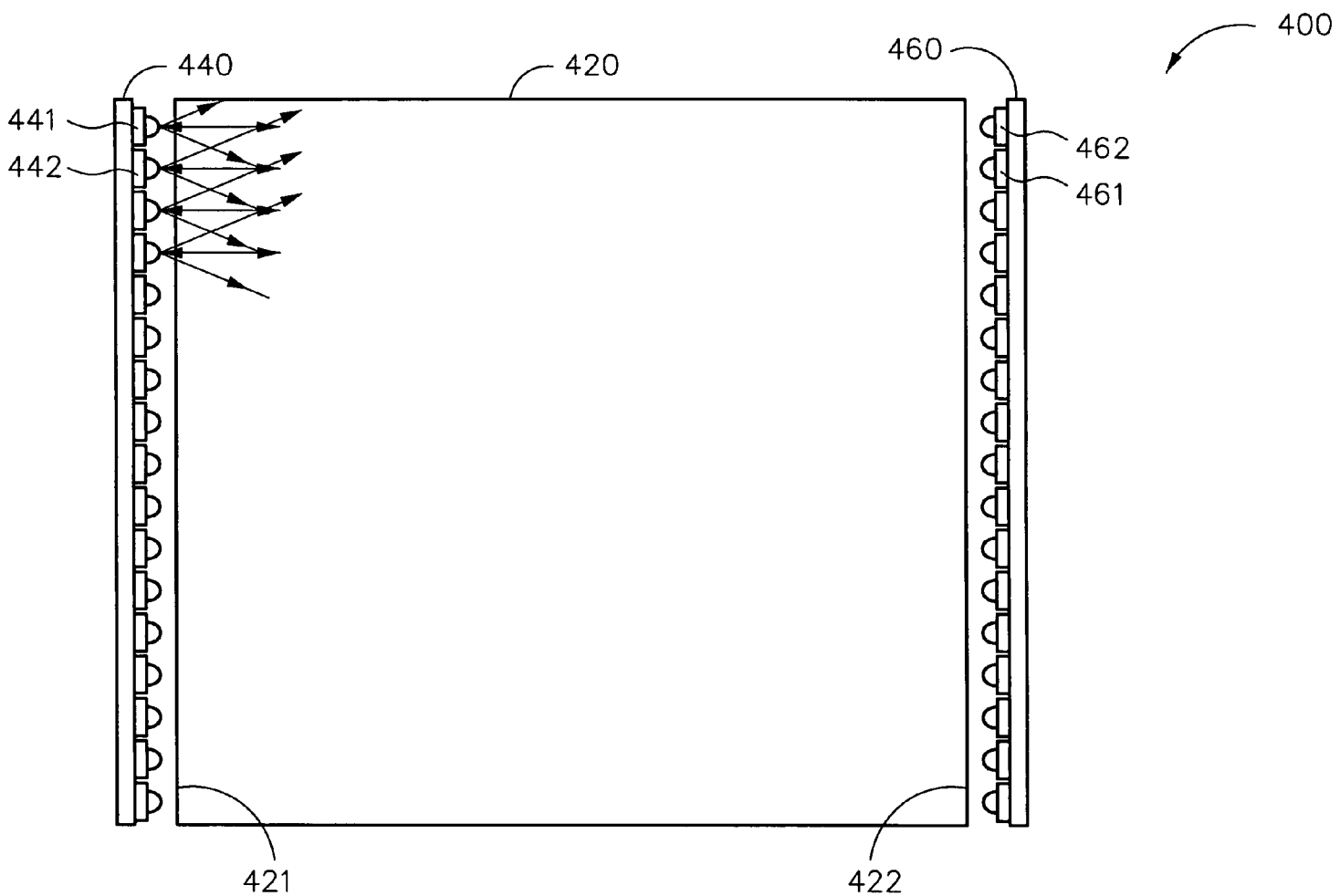
FIG. 4 is a schematic view of an embodiment of the illumination apparatus according to the present invention.

Referring to FIG. 4, an illumination apparatus 400 includes a light guide plate 420, a first light source module 440, and a second light source module 460. The light guide plate 420 has a first incident surface 421 and a second incident surface 422 opposite to the first incident surface 421. In the present embodiment, the first light source module 440 is a strip light source formed by the interlaced white LEDs 441, 442 with different color temperatures. The first light source module 440 is located by left side of the light guide plate 420 and provides a light beam into the first incident surface 421 of the light guide plate 420. The second light source module 460 is a strip light source formed by the interlaced white LEDs 461, 462 with different color temperatures. The second light source module 460 is located by right side of the light guide plate 420 and provides a light beam to the second incident surface 422 of the light guide plate 420.

The first light source module 440 and the second light source module 460 are opposite to each other and separated by the light guide plate 420. The first light source module 440 includes at least one first white LED 441 and at least one second white LED 442. In this embodiment, there are a plurality of the first white LEDs 441 and the second white LEDs 442. The second light source module 460 includes at least one third white LED 461 and at least one forth white LED 462. In this embodiment, there are a plurality of the third white LEDs 461 and the forth white LEDs 462.

The first white LED 441 has a first color temperature, and the second white LED 442 has a second color temperature different with the first color temperature. The third white LED 461 has a third color temperature, and the forth white LED 462 has a forth color temperature different with the third color temperature. In this embodiment, the first color temperature is the same as the second color temperature, and the second color temperature is the same as the forth color temperature.

The position of the third white LED 461 is corresponding to the position of the second white LED 442, and the position of the forth white LED 462 is corresponding to the position of the first white LED 441. In the present embodiment, the third white LED 461 is located opposite to the second white LED 442, and the forth white LED 462 is located opposite to the first white LED 441.

The first color temperature and the second color temperature may be selected one of the ranges from 2200K to 3000K, 3000K to 4500K, 4500K to 6500K, and 6500K to 10000K. For example, the first color temperature is 3000K and the second color temperature is 6000K. By selecting the color temperatures of the white LEDs, in the range of the color temperature from 3000K to 6000K, the color temperature and brightness of the illumination apparatus 400 may be adjusted optionally by a control system (not shown).

Figure 5:
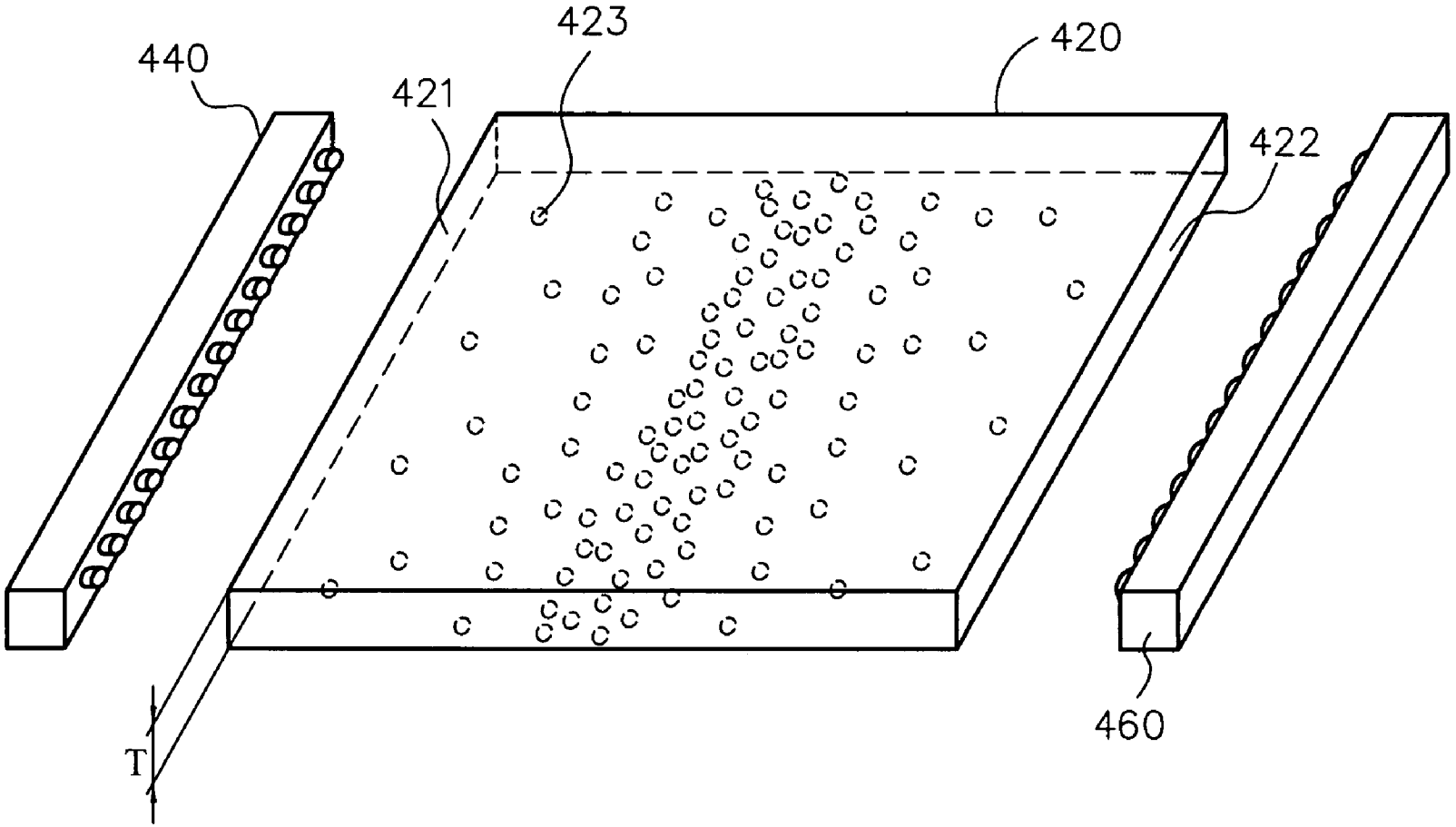
FIG. 5 is an exploded view of an embodiment of the illumination apparatus according to the present invention.

Referring to FIG. 5, in the present embodiment, the light guide plate 420 is a flat plate with dot pattern 423. The dot pattern 423 are usually on the bottom surface of the light guide plate 420. The light uniformity of the light guide plate 420 may be controlled by the size and density of the dot pattern 423. The color evenness of the light guide plate 420 may be controlled by the printing material of the dot pattern 423. In this way, the light beams from the first light source module 440 and the second light source module 460 are mixed inside the light guide plate 420. After multiple total reflections and scattering by the dot pattern 423, the illumination apparatus 400 may provide uniform white light.

In the present embodiment, the thickness T of the light guide plate 420 is smaller than 6 millimeter, so the whole thickness of the illumination apparatus 400 is smaller than 15 millimeter. The area of the emergent light is not restricted. The illumination apparatus 400 may be disposed on the ceiling of general office by light steel frame.

The flat light guide plate 420 in the above embodiments is used to provide uniform plane light, and the above embodiments are suitable for the large and thin indoor illumination apparatus 400. The white LEDs with two different color temperatures may decide the final adjustable range of the color temperature of the illumination apparatus 400. Moreover, the color temperature and the whole brightness of the illumination apparatus 400 may be adjusted by power control to change the current or the input time ratio.

For the white LEDs 441, 442, 461, 462 have different color temperatures, the light mixing ratio may be adjusted by controlling on-off time. Thus, the same brightness may be maintained when adjusting the color temperature. The brightness may be adjusted up to 100 scales, and the color temperature may be adjusted up to more than 256 scales.

Figure 6:
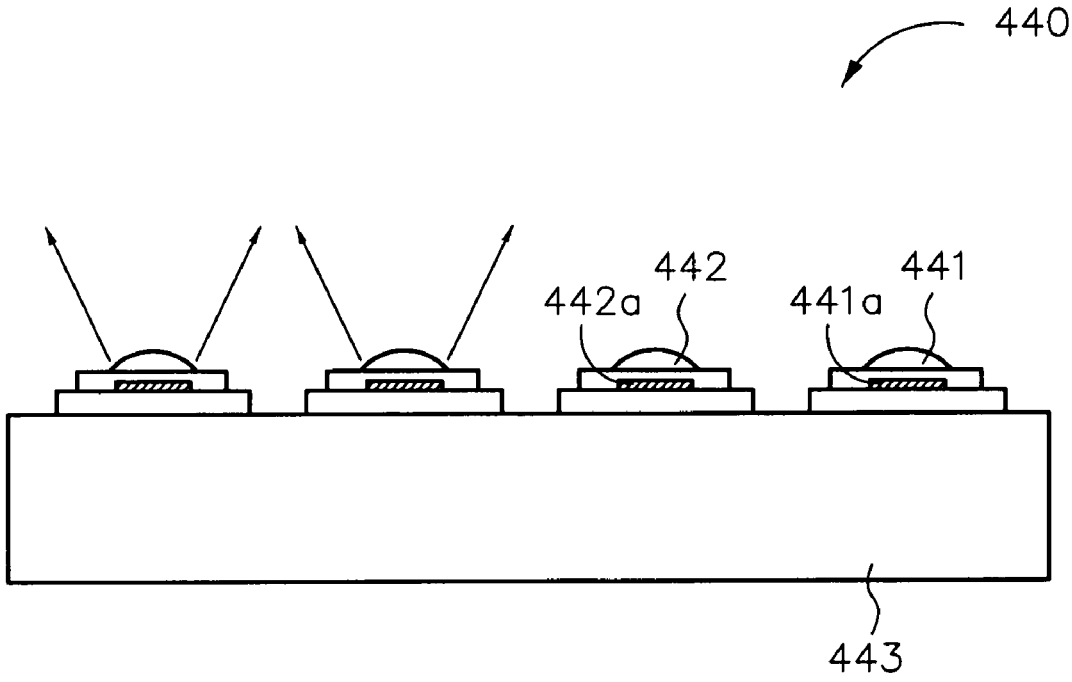
FIG. 6 is a sectional view of a light source module in accordance with an embodiment of the present invention.

Referring to FIG. 6, each of the first white LED 441 and the second white LED 442 of the first light source module 440 has a package structure, and the package structures contain LED dies 441*a*, 442*a* inside respectively. Taking the first light source module 440 for example, the package structures of the first white LED 441 and the second white LED 442 are interlaced and welded on the first printed circuit board (PCB) 443 by surface mount technology (SMT). Similarly, each of the third white LED 461 and the forth white LED 462 of the second light source module 460 has a package structure. The package structures of the first white LED 461 and the second white LED 462 are interlaced and welded on the second PCB (not shown) by SMT.

In an embodiment, the first light source module 440 or the second light source module 460 has at least two white LEDs with different color temperatures. The number of the first white LED 441 of the first light source module 440 may be same or different from the number of the second white LED 442. The number of the third white LED 461 of the second light source module 460 may be same or different with the number of the forth white LED 462. By selecting the color temperatures of the white LED, in the range of the color temperature from 2000K to 10000K, the color temperature and brightness of the illumination apparatus 400 may be adjusted optionally by a control system (not shown).

In the first light source module 440, the white LEDs 441, 442 with different color temperatures are interlaced. The ratio of the number of the two white LEDs 441, 442 may be 1:1, 1:2, 2:3, and so forth. In the second light source module 460 corresponding to the first light source module 440, the white LEDs 461, 462 with different color temperatures are also interlaced according to different ratio. However, when designing the type, the ratio of the number, and the arrangement of the white LEDs of the second light source module 460, the corresponding relations of the white LEDs 441, 442 of the first light source module 440 may be taken into account. FIG. 7A to 7D provide embodiments to illustrate the corresponding relations, but not to restrict the present invention.

Figure 7A:
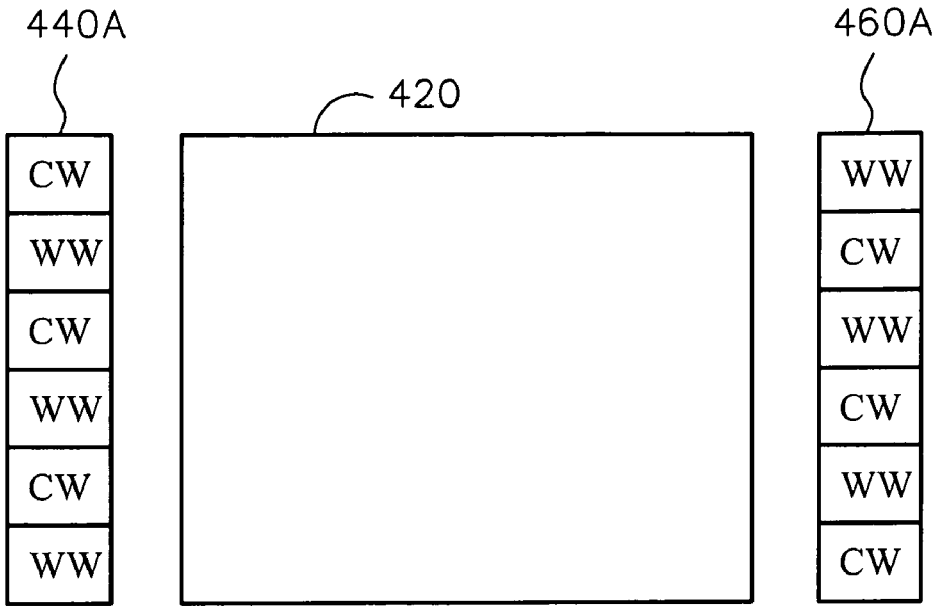
FIG. 7A to 7D are schematic views showing color temperatures arrangement of LEDs of the light source module in accordance with an embodiment of the present invention.

Referring to FIG. 7A, CW represents a 'cold white' LED with color temperature 6000K. WW represents a 'warm white' LED with color temperature 3000K. The light source modules 440A and 460A both include CW LEDs and WW LEDs, with a ratio of the number as 1:1. The white LEDs of the light source module 440A are arranged in the order of CW, WW, CW, WW . . . . The white LEDs of the light source module 460A are arranged in the order of WW, CW, WW, CW . . . . The CW LED of the light source module 440A is located opposite to the WW LED of the light source module 460A, and the WW LED of the light source module 440A is located opposite to the CW LED of the light source module 460A.

Figure 7B:
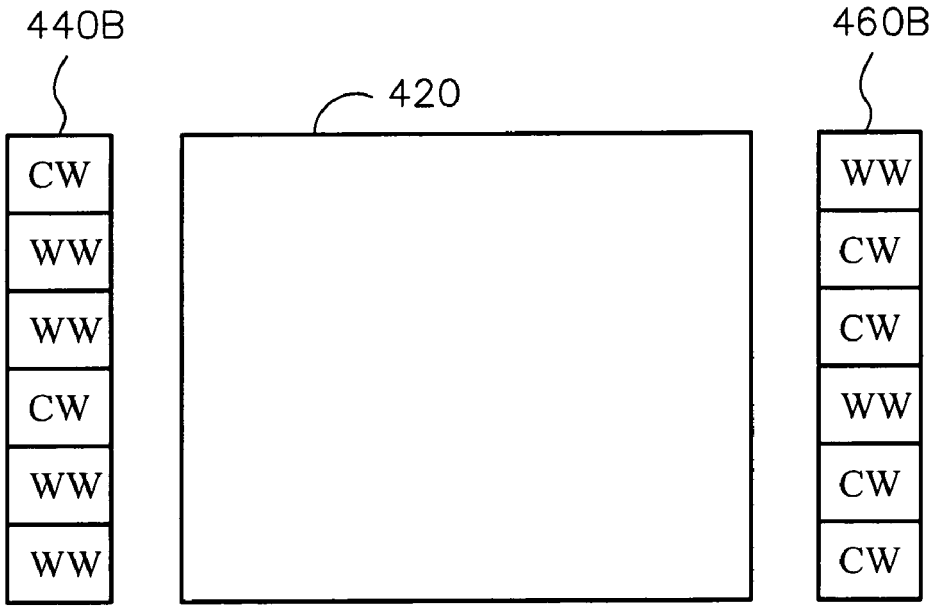

Referring to FIG. 7B, the ratio of the number of the CW LED and the WW LED in the light source modules 440B is 1:2, and the ratio of the number of the CW LED and the WW LED in the light source modules 460B is 2:1. The white LEDs of the light source module 440B are arranged in the order of CW, WW, WW . . . . The white LEDs of the light source module 460B are arranged in the order of WW, CW, CW . . . . Thus, the CW LED of the light source module 440B is located opposite to the WW LED of the light source module 460B, and the WW LED of the light source module 440B is located opposite to the CW LED of the light source module 460B.

Figure 7C:
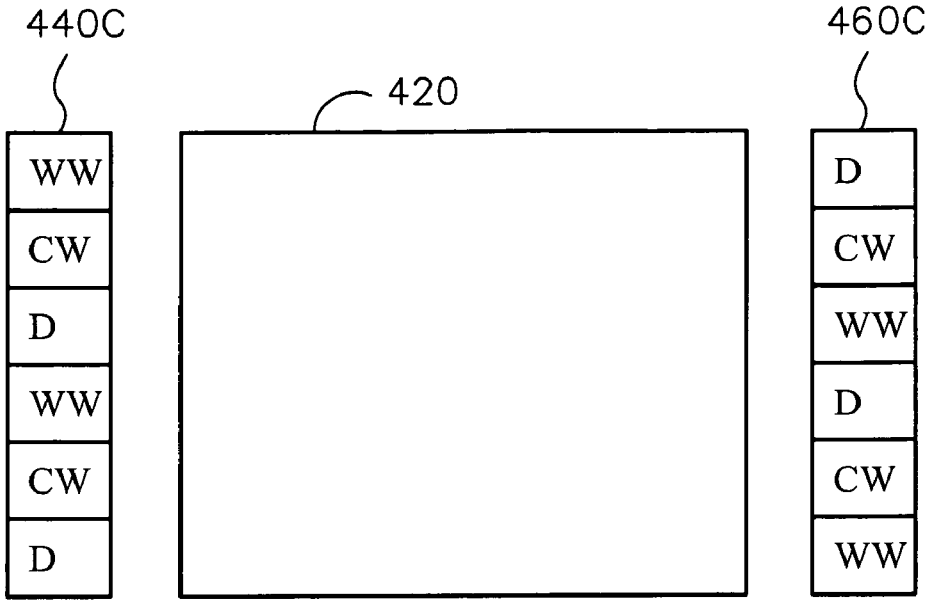

Referring to FIG. 7C, D represents a 'daylight' LED with color temperature 7000K. The ratio of the number of the CW LED, the WW LED, and the D LED in the light source module 440C and 460C is 1:1:1. The white LEDs of the light source module 440C are arranged in the order of WW, CW, D . . . . The white LEDs of the light source module 460C are arranged in the order of D, CW, WW . . . . Thus, the WW LED of the light source module 440C is located opposite to the D LED of the light source module 460C, and the D LED of the light source module 440C is located opposite to the WW LED of the light source module 460C.

Figure 7D:
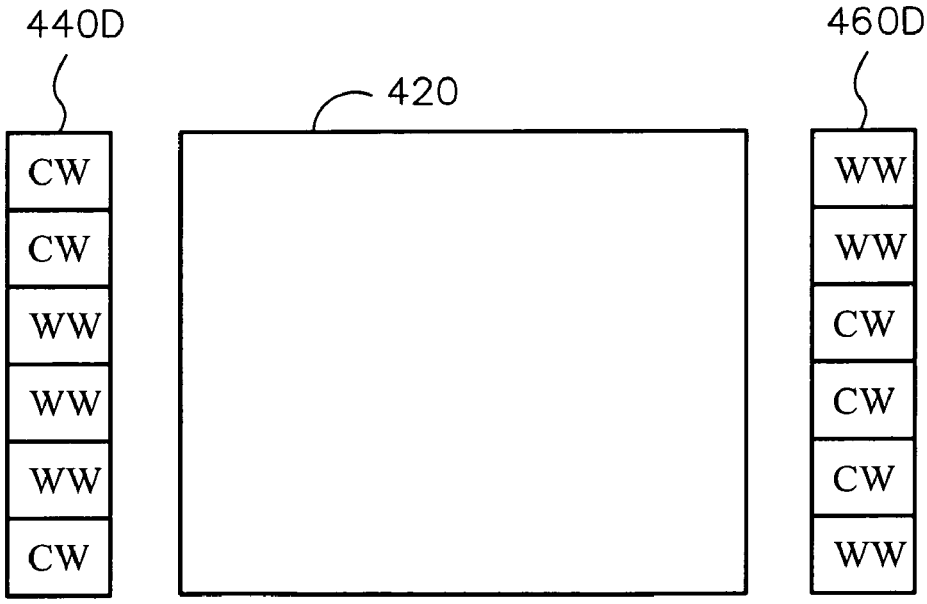

Referring to FIG. 7D, the ratio of the number of the CW LED and the WW LED in the light source modules 440D is 2:3, and the ratio of the number of the CW LED and the WW LED in the light source modules 460D is 3:2. The white LEDs of the light source module 440D are arranged in the order of CW, CW, WW, WW, WW . . . . The white LEDs of the light source module 460D are arranged in the order of WW, WW, CW, CW, CW . . . . Thus, the CW LED of the light source module 440D is located opposite to the WW LED of the light source module 460D, and the WW LED of the light source module 440D is located opposite to the CW LED of the light source module 460D.

In summary, the illumination apparatus 400 of the embodiment of the invention may have at least one of the following advantages:

1. The color temperature and brightness may be adjusted based on the time and the environment so as to increase working performance, reduce error rate, and enhance safety. Together with the proper control system, the illumination may be adjusted automatically according to day or night.

2. Because the space for mixing the light from the LED is located at the two sides of the light guide plate, the thickness of the illumination apparatus may not be increased. Hence the area of the emergent light of the illumination apparatus may be enlarged, and the thickness of lamp cover may stay thin at the same time.

3. The white LED package structure with a consistent color is fixed on the circuit board to keep the color appearance stable and avoid follow-up process affecting the light color of the illumination apparatus.

4. The flat light guide plate may decrease the thickness of the illumination apparatus effectively, and the light guide plate has a plurality of the light incident surfaces to expand the adjustable range of the color temperature and brightness, so as to provide uniform plane light and overcome glare caused by the conventional white LED lamp.

5. Compared with the traditional illumination apparatus using fluorescent lamp, halogen bulb, and energy-saving bulb as light source, the present illumination apparatus is more efficient, and has no ultraviolet and infrared radiation, so that the cost of energy and maintenance of the illumination apparatus may be saved. Besides, the illumination apparatus may be installed easily, and the life of the illumination apparatus may be more than 50000 hours.

The foregoing description of the preferred embodiment of the invention has been presented for purposes of illustration and description. It is not intended to be exhaustive or to limit the invention to the precise form or to exemplary embodiments disclosed. Accordingly, the foregoing description should be regarded as illustrative rather than restrictive. Obviously, many modifications and variations will be apparent to practitioners skilled in this art. The embodiments are chosen and described in order to best explain the principles of the invention and its best mode practical application, thereby to enable persons skilled in the art to understand the invention for various embodiments and with various modifications as are suited to the particular use or implementation contemplated. It is intended that the scope of the invention be defined by the claims appended hereto and their equivalents in which all terms are meant in their broadest reasonable sense unless otherwise indicated. Therefore, the term "the invention", "the present invention" or the like is not necessary limited the claim scope to a specific embodiment, and the reference to particularly preferred exemplary embodiments of the invention does not imply a limitation on the invention, and no such limitation is to be inferred. The invention is limited only by the spirit and scope of the appended claims. The abstract of the disclosure is provided to comply with the rules requiring an abstract, which will allow a searcher to quickly ascertain the subject matter of the technical disclosure of any patent issued from this disclosure. It is submitted with the understanding that it will not be used to interpret or limit the scope or meaning of the claims. Any advantages and benefits described may not apply to all embodiments of the invention. It should be appreciated that variations may be made in the embodiments described by persons skilled in the art without departing from the scope of the present invention as defined by the following claims. Moreover, no element and component in the present disclosure is intended to be dedicated to the public regardless of whether the element or component is explicitly recited in the following claims.

What is claimed is:

1. An illumination apparatus, comprising:

a light guide plate, having a first incident surface and a second incident surface opposite to the first incident surface;

a first light source module, capable of providing a light beam into the first incident surface of the light guide plate, the first light source module comprising at least one first white light emitting diode and at least one second white light emitting diode, wherein the first white light emitting diode has a first color temperature, the second white light emitting diode has a second color temperature different from the first color temperature; and a second light source module, capable of providing a light beam into the second incident surface of the light guide plate, the second light source module comprising at least one third white light emitting diode and at least one forth white light emitting diode, the third white light emitting diode having a third color temperature, the forth white light emitting diode having a forth color temperature different from the third color temperature, wherein the position of the third white light emitting diode is corresponding to the position of the second white light emitting diode, and the position of the forth white light emitting diode is corresponding to the position of the first white light emitting diode.

2. The illumination apparatus of claim 1, wherein the first color temperature is the same as the third color temperature, and the second color temperature is the same as the forth color temperature.

3. The illumination apparatus of claim 2, wherein the third white light emitting diode is located opposite to the second white light emitting diode, and the forth white light emitting diode is located opposite to the first white light emitting diode.

4. The illumination apparatus of claim 1, wherein the thickness of the light guide plate is smaller than 6 millimeters.

5. The illumination apparatus of claim 1, wherein the first light source module comprises a first printed circuit board, each of the first white light emitting diode and the second white light emitting diode comprises a package structure, and the package structures of the first white light emitting diode and the second white light emitting diode are fixed on the first printed circuit board by surface mount technology.

6. The illumination apparatus of claim 1, wherein the second light source module further comprises a second printed circuit board, each of the third white light emitting diode and the forth white light emitting diode comprises a package structure, and the package structures of the third white light emitting diode and the forth white light emitting diode are fixed on the second printed circuit board by surface mount technology.

7. The illumination apparatus of claim 1, wherein the light guide plate is a flat plate with dot pattern.

8. The illumination apparatus of claim 1, wherein the number of the first white light emitting diode and the number of the second white light emitting diode of the first light source module are different.

9. The illumination apparatus of claim 1, wherein the number of the first white light emitting diode and the number of the second white light emitting diode of the first light source module are the same.

10. The illumination apparatus of claim 1, wherein the number of the third white light emitting diode and the number of the forth white light emitting diode of the second light source module are different.

11. The illumination apparatus of claim 1, wherein the number of the third white light emitting diode and the number of the forth white light emitting diode of the second light source module are the same.

12. The illumination apparatus of claim 1, wherein the first color temperature is in one of the ranges from 2200K to 3000K, 3000K to 4500K, 4500K to 6500K, and 6500K to 10000K.

13. The illumination apparatus of claim 1, wherein the second color temperature is in one of the ranges from 2200K to 3000K, 3000K to 4500K, 4500K to 6500K, and 6500K to 10000K.

* * * * *